United States Patent [19]

Kaneko

[11] 4,277,723

[45] Jul. 7, 1981

[54] SYMMETRICAL MAGNETRON WITH OUTPUT MEANS ON CENTER AXIS

[75] Inventor: Kazuo Kaneko, Yokohama, Japan

[73] Assignee: Hitachi, Ltd., Tokyo, Japan

[21] Appl. No.: 15,131

[22] Filed: Feb. 26, 1979

[30] Foreign Application Priority Data

Feb. 24, 1978 [JP] Japan ..... 53/19793

[51] Int. Cl.[3] ..... H01J 25/50

[52] U.S. Cl. ..... 315/39.77; 315/39.51; 315/39.75

[58] Field of Search ..... 315/39.51, 39.75, 39.77

[56] References Cited

U.S. PATENT DOCUMENTS

| | | | |
|---|---|---|---|
| 2,611,110 | 9/1952 | Powers | 315/39.77 X |
| 2,666,165 | 1/1954 | Hutchinson | 315/39.77 X |
| 3,334,268 | 8/1967 | Downing | 315/39.77 X |
| 3,987,333 | 10/1976 | Nakada et al. | 315/39.77 |

FOREIGN PATENT DOCUMENTS

| | | | |
|---|---|---|---|
| 827360 | 2/1960 | United Kingdom | 315/39.77 |
| 523589 | 9/1974 | U.S.S.R. | 315/39.77 |

*Primary Examiner*—Saxfield Chatmon, Jr.

*Attorney, Agent, or Firm*—Craig & Antonelli

[57] ABSTRACT

A magnetron suited for use in microwave ovens includes a cylindrical anode surrounding interaction spaces for producing a microwave and a cylindrical portion extending from the cylindrical anode. A partition disk-like plate having a plurality of coupling openings is disposed in the cylindrical extension thereby to define a coaxial type cavity resonator. The coupling openings of the partition plate are located in the vicinity of vanes provided in the interaction spaces for producing the microwave and positioned in alignment with every other one of the vanes. An inner conductor of the coaxial type cavity resonator has an end connected to the partition plate and the other end extending to the end of the cylindrical anode. The center axis of the cavity resonator substantially coincides with that of the cylindrical anode. The end of the extension of the cylindrical anode is closed by a conductor plate through an insulator member disposed between the conductive plate and the other end portion of the inner conductor. An output antenna connected to the inner conductor at the side of the closed end projects outwardly in coaxial alignment with the cylindrical anode.

8 Claims, 5 Drawing Figures

SYMMETRICAL MAGNETRON WITH OUTPUT MEANS ON CENTER AXIS

The present invention relates to a structure of magnetron and in particular to an improvement in the magnetrons suited for use in microwave ovens.

In general, a magnetic field of a great strength is required for effective operation of the magnetron. To this end, it was a common practice to provide large magnets outside of the magnetron. Recently, development of new magnetic materials has made it possible to implement a magnet of a small size which is nevertheless capable of producing a magnetic field of a great strength, as a result of which the magnet can be located in the interior of the magnetron. Thus, a considerable miniaturization or reduction in the size of the magnetron has now been attained.

In FIG. 1, there is shown in a vertical sectional view a main portion of a typical example of the prior art magnetron having permanent magnets accommodated therein. Referring to FIG. 1, reference numeral 1 denotes a cylindrical anode made of a ferromagnetic material which may also be referred to as anode cylinder. Yokes 13 and 14 which are also made of a ferromagnetic material are located at the top and the bottom of the hollow anode cylinder 1, respectively. Permanent magnets 11 and 12 are fixedly mounted on the yokes 13 and 14 in the interior of the magnetron by means of holder members 15 and 16 of a non-magnetic material, respectively. In the case of the illustrated example, it is assumed that the permanent magnet 11 is realized in a ring-like configuration, while the permanent magnet 12 is of a disk-like form, both of these magnets being magnetized in the direction of the thickness, i.e. in the direction of the vertical axis X of the magnetron as viewed in the figure. A cathode 3 is fixedly suspended by lead wires 31 for heating. The lead wires 31 in turn are secured at an isolator 33. A number of vanes 4 are formed in the inner wall of the anode cylinder 1 and distributed uniformly in a circular array coaxial with the cathode 3. As is well known in the art, microwave energy is generated in interation spaces defined between the cathode 3 and the vanes 4 in the magnetic field produced by the permanent magnets 11 and 12. The microwave energy thus generated is transmitted to a cap-like antenna 53 through a conductor 51 to be radiated outwardly therefrom. Numeral 55 designates an insulator sleeve of a dielectric material for the insulation of high frequency energy. The anode cylinder 1 of a ferromagnetic material serves also as a yoke for conducting magnetic flux therethrough.

In the hitherto known magnetron of the structure described above, the output antenna 53 is located at a position remarkably offset from the center axis X of the magnetron, as can be clearly seen from FIG. 1. Consequently, as compared with the magnetron having the permanent magnets mounted externally and the output antenna located concentrically with the center axis of the magnetron, the internal magnet type magnetron described above will encounter some difficulty and inconveniences when the magnetron is installed or incorporated in waveguides, microwave ovens or the like. In other words, because of the asymmetrical position of the output antenna, a holding structure for supporting stationarily the magnetron will necessarily take an asymmetrical position and/or unbalanced state in the waveguide or the like, whereby the procedures for mounting the magnetron will become much complicated, making the mounting work troublesome. Further, due to the asymmetric position of the output antenna, there may arise such situation that the force required for supporting the magnetron may be non-uniformly distributed in the holding structure and give rise to deterioration in performance and eventually damage and destruction of the magnetron particularly when undesirable thermal stress is induced by heat produced in the magnetron.

Putting aside the geometrical configurations described above, the hitherto known magnetron tends to generate in addition to the microwave of a fundamental oscillation frequency unnecessary frequency components having frequencies higher and lower than the fundamental frequency. For example, in the case of a magnetron destined to be used for a microwave oven and having a fundamental frequency of 2450 MHz, unnecessary or unwated microwaves in a range of $\pm 200$ to $\pm 300$ MHz with reference to the fundamental microwave are produced and often provides a great obstacle in designing the microwave oven. In reality, it is statutorily regulated that the frequency assigned to a practical microwave oven has to be in the range of 2450 MHz$\pm$50 MHz. In order to meet such severe statutory regulation, measures must be provided to prevent the unwanted frequency waves such as mentioned above from leaking outwardly. Besides, in the case of the microwave oven, the leakage of the fundamental frequency component of 2450 MHz is statutorily required to be reduced to a negligible energy level. Accordingly, upon designing the means for suppressing the leakage of the microwave energy provided at the door or the like of the heating chamber of the microwave oven, consideration has to be taken for a plurality of the frequencies when the unwanted frequency components are significantly deviated from the fundamental frequency. Thus, the means for preventing the leakage of microwaves in the applications of the higherto known magnetrons become much complicated and involve increased manufacturing costs as a whole.

Accordingly, an object of the present invention is to provide a magnetron which can be incorporated in magnetron devices such as a microwave oven in a much facilitated and simplified manner without involving deterioration in performance and damages or destruction of the magnetron and which may be used preferably and advantageously for microwave oven.

In view of the above and other objects which will become more apparent as description proceeds, the invention teaches that permanent magnets are provided at an upper and a lower side of vanes positioned surrounding a cathode, respectively, with the lower permanent magnet being implemented in a circular form and located coaxially with the center axis of the magnetron. Coupling between the antenna for outputting the microwave energy and the vanes is realized by providing a coaxial type cavity resonator between the vanes and the antenna and connecting the antenna to a central conductor of the coaxial type cavity resonator, thereby to assure a symmetrical structure of the magnetron and at the same time to prevent leakage of unwanted microwave component by making use of a filter function of the cavity resonator.

The coupling between the vanes and the coaxial type resonator may be effected by means of a partition plate having coupling openings formed therein or a partition plate having coupling conductor wires extending therethrough in addition to the coupling openings.

The invention will be better understood by examining the following description on the exemplary embodiments taken in conjunction with the accompanying drawings, in which.

Now, the invention will be described by referring to FIG. 2 which shows in a sectional view a main structure of a magnetron according to an embodiment of the invention and in which same reference numerals are used to denote elements and members having same functions as those shown in FIG. 1.

Figure 1:
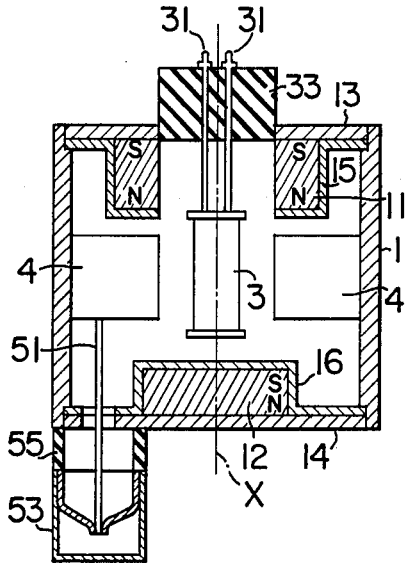
FIG.1 PRIOR ART
FIG. 1 is a vertical sectional view showing a main portion of a typical example of higherto known magnetrons accommodating therein permanent magnets.
Figure 2:
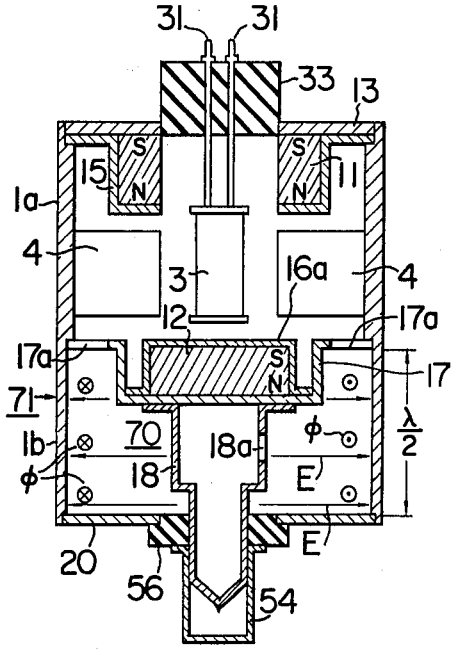
FIG. 2 is a vertical sectional view showing a main structure of a magnetron according to an exemplary embodiment of the invention.

As can be seen from FIG. 2, an anode cylinder made of a ferromagnetic material of the magnetron according to the invention includes an intrinsic or first cylindrical anode 1*a* which extends downwardly below the position of a lower permanent magnet 12 and defined interaction spaces of the magnetron and an outer conductor portion 1*b* of a coaxial type cavity resonator 71. Although the outer conductor portion 1*b* extending downwardly is shown as being formed integrally with the cylindrical anode 1*a* of the same ferromagnetic material as the latter, it will be appreciated that the outer conductor portion 1*b* may be made of a material different from that of the cylindrical anode 1*a*. The permanent magnet 12 is fixedly mounted on a partition plate 17 at a middle portion thereof by means of a holder member 16*a* which is made of a non-magnetic metallic material. On the other hand, the partition plate 17 is formed of a ferromagnetic material and serves also as a yoke. A plurality of coupling openings 17*a* are formed in the partition plate 17 in the vicinity of and in axial alignment with every other one of the vanes 4 for transmitting the microwave energy to the coaxial type cavity resonator 71. Mounted at the lower surface of the partition plate 17 at a middle portion thereof is a metallic cylinder 18 which constitutes an inner conductor of the coaxial cavity resonator 71. The lower portion of the metallic cylinder 18 is reduced in diameter and extends through a dielectric seal member 56 downwardly beyond the lower edge of the outer cylindrical conductor portion 1*b*. The lower end portion of the inner metallic cylinder 18 is tapered downwardly. The lower side of the outer conductor portion 1*b* is closed by the dielectric seal member 56 and an electrically conductive plate 20. The tapered lower end portion of the metallic cylinder 18 is connected to an antenna member 54. A through-hole 18*a* formed in a side wall of the metallic cylinder (inner cylindrical conductor) 18 is destined to be used as an evacuating hole for producing vacuum in the interior of the magnetron.

With the arrangement of the magnetron described above, inherent operation of the magnetron takes place in the interaction spaces defined above the partition plate 17 in a similar manner as in the case of the hitherto known magnetron, whereby the microwave power or energy is generated. Formed below the partition wall 17 is the coaxial type cavity resonator 71 to which the microwave energy as generated is transmitted through the coupling openings 17*a* formed in the partition wall 17 and hence radiated from the antenna 54 through the metallic cylinder 18 which constitutes the center conductor.

Figure 3:
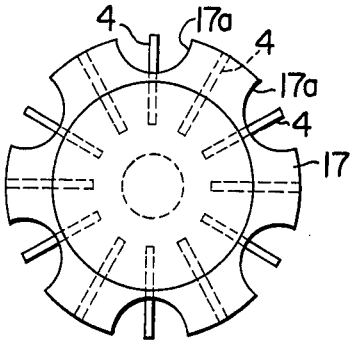
FIG. 3 is a bottom plan view of the magnetron shown in FIG. 2 and illustrates positional relationship between vanes and a partition plate having coupling openings formed therein.

As is shown in FIG. 3, the coupling openings 17*a* are formed along the peripheral edge portion of the partition plate 17 each in vertical alignment with every other one of the vanes 4. By virtue of such arrangement, the output antenna 54 can be positioned on the center axis of the magnetron.

Figure 4:
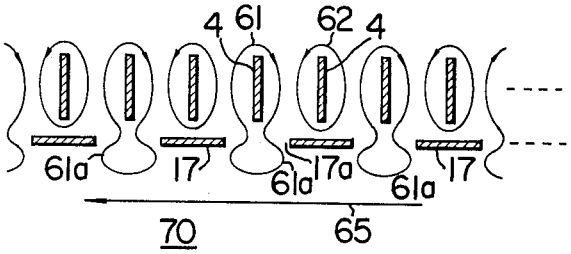
FIG. 4 is an exploded view of FIG. 3 to illustrate operation taking place between the vanes and the partition plate.

Next, description will be made on the operation of the magnetron shown in FIG. 2. As is well known in the art, when the magnetron is caused to oscillate in $\pi$-mode operation, magnetic fields of a high frequency are produced individually around the vanes 4 in such manner that each of the magnetic fields surrounding each of the vanes 4 has a direction which reverses alternatively and successively for every one of the vanes 4. Such pattern of the magnetic fields as generated is schematically illustrated in FIG. 4 which is a flatly exploded fragmental view of the magnetron shown in FIG. 2. The high frequency magnetic fields 61 and 62 which surround the adjacent ones of the vanes 4, respectively, are in the directions opposite to each other. The two adjacent vanes 4 constitute one anode resonator. Because each of the coupling openings 17*a* formed in the partition plate 17 are positioned in the vicinity of every other one of the vanes 4, the magnetic fields 61 produced around the vanes 4 which are positioned in alignment with the openings 17*a* may intrude into the cavity space 70 through the associated coupling openings as indicated by 61*a*, whereby the coupling is established between the intrinsic magnetron and the coaxial cavity resonator 71. In this conjunction, it will be noted that the magnetic fields 61*a* coupled to the cavity 70 are all of the same direction, i.e. in phase with one another as illustrated in FIG. 4, since the coupling openings 17*a* are associated with every other vanes 4 and the magnetic fields reverse the direction thereof alternatively for every vane as described above. Consequently, there is produced in the cavity 70 a combined magnetic field 65 in an equivalent sense which is rotated in phase with the intruding magnetic fields 61*a*. Each of the magnetic fields 61 and 62 generated around the respective vanes 4 has a field strength increased progressively toward the foot of the vane, i.e. toward the inner wall of the cylindrical anode 1*a*. Accordingly, the coupling openings 17*a* which are formed in the peripheral edge of the partition wall 17 extending along the inner wall of the cylindrical anode 1*a* will allow the magnetic fields 61 to be propagated into the cavity 70 with a correspondingly increased degree of coupling. The cavity space 70 is implemented in a form of a coaxial line between the metallic cylinder 18 and the outer conductor portion 1*b* which is the extension of the cylindrical anode 1*a* while being delimited by the partition plate 17 on one hand and the conductor plate 20 on the other hand, thereby to form the coaxial cavity resonator 71. Under these conditions, when the distance between the coupling openings 17*a* of the partition plate 17 and the conductor plate 20 is selected substantially equal to a half of the wavelength λ of the microwave at which the oscillation takes place, then the coaxial cavity resonator will resonate at the oscillation frequency, as the result of which a much more increased degree of coupling can be attained. In FIG. 2, symbol $\phi$ represents the mode of the combined magnetic fields of microwave energy, while E represents the mode of electric field prevailing within the coaxial type cavity resonator. In this manner, microwave energy is radiated outwardly from the output antenna 54 connected to the center conductor which is constituted by the metallic cylinder 18.

When the metallic cylinder 18 constituting the center conductor of the coaxial type cavity resonator 71 is made of a material which is less susceptible to involving a loss of microwave energy, a high Q can be attained in the coaxial cavity resonator, which will then be able to function as a bandpass filter of a narrow bandwidth thereby to effectively prevent the unwanted frequency components from leaking. The ferromagnetic material for the cylindrical anode 1*a* and the outer conductor 1*b* should not preferrably suffer from any appreciable loss of microwave energy. Alternately, it is equally effective to provide a liner of a metallic material involving only a negligible loss of microwave energy on the inner wall of the anode cylinder 1. Since the looped magnetic circuit for the permanent magnets 11 and 12 is formed by the patition plate 17 serving also as the yoke, the cylindrical anode 1*a* and the upper yoke 13, the outer conductor portion 1*b* constituting the extension of the cylindrical anode 1*a* may be made of a material different from that of the latter, as described hereinbefore. In this case, consideration is to be taken in the selection of the material for the outer conductor portion 1*b* such that loss of the microwave energy may scarcely be induced.

Figure 5:
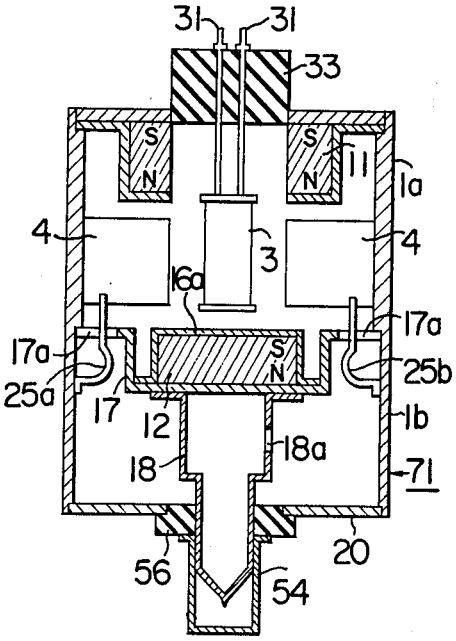
FIG. 5 is a sectional view showing a main structure of the magnetron according to another exemplary embodiment of the invention.

FIG. 5 is a sectional view showing a main structure of the magnetron according to another embodiment of the invention, which differs from the structure of magnetron in that coupling wires 25*a* and 25*b* extending through the coupling openings 17*a* and connected to the respective vanes 4 are provided for effecting the coupling between the microwave generator portion and the cavity resonator in addition to the coupling openings 17*a* with a view to enhancing the degree of coupling of the microwave energy into the coaxial type cavity resonator 71. In this connection, it is to be noted that the coupling conductor wires 25*a* and 25*b* are not necessarily provided for all the coupling openings 17*a*. It will be sufficient to provide the single coupling conductor wire 25 for a given number of coupling openings. When a plurality of the coupling conductor wires are employed, they should preferably be located at the coupling openings positioned symmetrically relative to the center point of the cylindrical anode 1*a*.

I claim:

1. A symmetrical magnetron comprising:

an anode cylinder provided with a plurality of vanes arrayed at the inner circumferential surface so as to form anode resonators positioned around a cathode;

a partition member having coupling openings formed therein and located in the vicinity of said vanes, each of said coupling openings being positioned in alignment with every other one of said vanes in said circumferential array;

a coaxial type cavity resonator provided in opposition to said vanes with said partition member being interposed therebetween and including a center conductor having a center axis substantially coinciding with the center axis of said anode cylinder, said coaxial type cavity resonator being adapted to be supplied with microwave energy through said coupling openings formed in said partition member;

means for radiating the microwave energy from the tip end of said center conductor of said coaxial type cavity resonator; and means for insulating said radiating means from said cavity.

2. A symmetrical magnetron comprising:

an anode cylinder provided with a plurality of vanes arrayed at the inner circumferential surface so as to form anode resonators positioned around a cathode;

a partition plate having coupling openings formed therein and located in the vicinity of said array of vanes, each of said coupling openings being positioned in alignment with every other one of said vanes in said circumferential array;

permanent magnets positioned at a middle portion of said partition plate for producing a magnetic field running in a direction parallel to said vanes;

a coaxial type cavity resonator including an inner cylindrical conductor having one end connected to said partition plate at a middle portion thereof and extending in a direction opposite to said vanes, a portion of said anode cylinder extending in the direction opposite to said vanes from said partition plate and constituting an outer conductor and a conductor plate connected to the other end portion of said cylindrical conductor through an isolator and closing an end of said portion of said anode cylinder;

means for radiating microwave energy from the other end of said cylindrical conductor; and means for insulating said radiating means from said cavity.

3. A symmetrical magnetron as set forth in claim 1 or 2, wherein at least one of said coupling openings includes a coupling conductor which is connected to the vane positioned in alignment with said one coupling opening and extends through said one coupling opening into the cavity of said coaxial type cavity resonator.

4. A symmetrical magnetron as set forth in claim 2, wherein said microwave energy radiating means includes an antenna conductor connected to said cylindrical conductor and projecting outwardly from the end of said portion of said anode cylinder.

5. A symmetrical magnetron as set forth in claim 2, wherein said cylindrical conductor is provided with an evacuating hole for producing vacuum within the interior of said cylindrical anode upon manufacturing said magnetron.

6. A symmetrical magnetron as set forth in claim 1 or 2, wherein said anode cylinder is made of a material which exhibits at least properties of a ferromagnetic material.

7. A symmetrical magnetron as set forth in claim 2, wherein said anode cylinder and said partition plate having said coupling openings formed therein are made of a material which exhibit at least properties of a ferromagnetic material.

8. A symmetrical magnetron as set forth in claim 1 or 2, wherein said coaxial type cavity resonator has a length which is substantially equal to one-half of the wavelength of the microwave as produced.

* * * * *